US007621050B2

(12) United States Patent
Okabe et al.

(10) Patent No.: US 7,621,050 B2
(45) Date of Patent: Nov. 24, 2009

(54) INNER CUTTER FOR A RECIPROCATING TYPE ELECTRIC SHAVER

(75) Inventors: Masaki Okabe, Matsumoto (JP); Tetsuhiko Shimizu, Matsumoto (JP); Yoshiyuki Mimura, Matsumoto (JP)

(73) Assignee: Izumi Products Company, Nagano (JP)

( * ) Notice: Subject to any disclaimer, the term of this patent is extended or adjusted under 35 U.S.C. 154(b) by 109 days.

(21) Appl. No.: 11/507,559

(22) Filed: Aug. 21, 2006

(65) Prior Publication Data

US 2007/0044314 A1 Mar. 1, 2007

(30) Foreign Application Priority Data

Aug. 23, 2005 (JP) ..... 2005-240972

(51) Int. Cl.
*B26B 19/28* (2006.01)
*B26B 19/04* (2006.01)

(52) U.S. Cl. ..... 30/44; 30/43.91; 30/346.51

(58) Field of Classification Search ..... 30/44, 30/43.91, 43.7, 346.51, 43.8, 43.92, 34.2, 30/34.5, 50, 32
See application file for complete search history.

(56) References Cited

U.S. PATENT DOCUMENTS

| | | | | |
|---|---|---|---|---|
| 3,453,909 A | | 7/1969 | Yager | |
| 4,170,822 A | | 10/1979 | Groothuis et al. | |
| 4,510,687 A | * | 4/1985 | Groothuis et al. | 30/43.92 |
| 5,669,138 A | * | 9/1997 | Wetzel | 30/43.92 |
| 6,052,904 A | * | 4/2000 | Wetzel et al. | 30/43.92 |
| 6,233,829 B1 | * | 5/2001 | Oglesby et al. | 30/34.2 |
| 2006/0021234 A1 | * | 2/2006 | Yanosaka et al. | 30/346.51 |
| 2006/0150421 A1 | * | 7/2006 | Sato et al. | 30/43.91 |

FOREIGN PATENT DOCUMENTS

| | | |
|---|---|---|
| EP | 0 080 303 | 6/1983 |
| GB | 775 078 | 5/1957 |
| GB | 2 114 042 | 8/1983 |
| JP | 62-148684 | 7/1987 |
| JP | 10-323461 | 12/1998 |

* cited by examiner

*Primary Examiner*—Ghassem Alie
(74) *Attorney, Agent, or Firm*—William L. Androlia; H. Henry Koda

(57) ABSTRACT

An inner cutter of a reciprocating electric shaver having a plurality of arched shaped cutter blades that are integrally formed on a side edge part of the inner cutter and, while making reciprocating motion, makes sliding contact with an inside surface of an arch shaped outer cutter. The end portions of two adjacent cutter blades are joined together and this joined portion is connected to the side edge part via a connecting portion.

5 Claims, 5 Drawing Sheets

INNER CUTTER FOR A RECIPROCATING TYPE ELECTRIC SHAVER

BACKGROUND OF THE INVENTION

1. Field of the Invention

The present invention relates to an inner cutter for a reciprocating type electric shaver in which a plurality of arch-shaped cutter blades are integrally formed, and these cutter blades make sliding contact with the inside surface of an arch-shaped outer cutter while making reciprocating motion.

2. Description of the Related Art

In a reciprocating type electric shaver, an inner cutter, while making reciprocating motion, makes sliding contact with the inside surface of an arch-shaped outer cutter and cuts whiskers (hair) that enter the openings formed in the outer and inner cutters; and there are typically two types of inner cutters. One is an assembled-type inner cutter, and the other is an integral-type inner cutter, as disclosed in Japanese Patent Application Laid-Open (Kokai) No. S62-148684.

In the assembled-type inner cutter, a plurality of semicircular cutter blades are punched out of a thin sheet, and these semicircular cutter blades are aligned at fixed intervals and supported in a supporting stand. In this inner cutter, a plurality of cutter blades are prepared separately from one another, and the centers and both end portions of these cutter blades are attached to and supported by a support member. Accordingly, the problem with this assembled-type inner cutter is that assembly is troublesome, it takes many manufacturing steps, and the productivity is low.

On the other hand, in the integral-type inner cutter, all the cutter blades are integrated. In one of the integral-type inner cutter, for example, slits (grooves) are formed in a transverse direction in a tubular base material, so that the arch-shaped portions remained between the slits becomes the cutter blades. It is also possible to bend a thin sheet of metal or ceramic or the like in a substantially arch shape and form slits by cutting along the ridge line, thus forming arch-shaped cutter blades that are parallel and at a fixed interval.

In another integral-type inner cutter, the inner cutter is integrally formed of a soft material such as plastic or the like, and a coating layer of chromium or the like is formed on its entire surface, and then its sliding surface with the inside surface of the outer cutter is polished, as disclosed in Japanese Patent Application Laid-Open (Kokai) No. S62-148684.

Meanwhile, when an electric shaver is used, vibration and sound are generated by the internal electric motor and drive mechanism, and sound (cutting sound, shaving sound, friction sound) also occurs due to the blade vibration when cutting hair that has entered the openings of the outer and inner cutters and due to the vibration caused by friction between the outer cutter and the inner cutter. The hair cutting sound and friction sound due to the outer cutter and the inner cutter in particular are likely to be sensed by the user because the outer cutter makes direct contact with the skin. Accordingly, they directly affect how good or bad the use feeling of the shaver is.

In view of the issues above, in one of the proposed inner cutters, a plurality of projecting strips, that intersect the inner cutter sliding direction, are formed in a single flat metal sheet, this metal sheet is bent in the direction orthogonal to the sliding direction to make an arch shape, and then the outer peripheral surface is polished to separate the cutter blades (Japanese Patent Application Laid-Open (Kokai) No. H10-323461). In other words, in this inner cutter, projecting strips are provided in a flat metal sheet by forming a plurality of cut grooves by pressing or by using a grinding wheel, and these projecting strips are separated by polishing the outer periphery, thus making an arch-shaped cutter blade and thereby enhancing the cutting sound when in use.

In the assembled-type inner cutter disclosed in this Japanese Patent Application Laid-Open (Kokai) No. H10-323461, since the center part of the cutter blade is supported by an inner cutter stand, the cutter blade (inner cutter sheet (15)) is not very flexible, and cutting sound is difficult to generate (as described in paragraph 0022 of this prior art). This prior art, Japanese Patent Application Laid-Open (Kokai) No. H10-323461, further describes that cut-outs ((71) in FIG. 9) are provided at the inner peripheral edge of the cutter blade so as to increase the arch-bending workability and to improve the fit with the outer cutter, thus improving the cutting feeling (see paragraph 0082 of this prior art).

However, in the inner cutter of this Japanese Patent Application Laid-Open (Kokai) No. H10-323461, the vibration characteristics and intrinsic vibration frequency of the cutter blades are determined, for instance, by the thickness of the flat sheet that is used, by the height of the projecting strips (width of the cutter blade in the radial direction), and by the thickness of the projecting strips (thickness of the cutter blade in the inner cutter reciprocating direction). Therefore, even if the cutting sound can be made loud by changing these parameters, it is difficult to provide suitable sound quality.

Accordingly, a concept that has been considered is to make the cutter blades vibrate easily in the inner cutter reciprocating direction and actively generate an excellent sound. The applicant of the present application has proposed, in Japanese Patent Application No. 2004-042658, to form a vibration control part for allowing vibration of the cutter blades near the connecting portion that connects both end portions of an arch-shaped cutter blade to the side edge part.

However, when vibration of the cutter blades are actively utilized in this manner to improve the sound quality, stress concentrates at the connecting portion between both end portions of the cutter blades and the side edge part, and a problem of low durability was found. An opposite strategy was thus considered—improving durability by shortening the cutter blades and making vibration difficult —, but in this case the problem of low sound quality occurred.

BRIEF SUMMARY OF THE INVENTION

The present invention is devised in light of the facts described above.

The object of the present invention is to provide an inner cutter for a reciprocating type electric shaver that is an integral-type inner cutter that has good sound quality when in use, that can easily create a good use feeling and a desired tone, and that can disperse the stress applied to the cutter blades and improve the durability.

The above object is accomplished by a unique structure of the present invention for an inner cutter for a reciprocating type electric shaver in which a plurality of arch-shaped cutter blades are integrally formed on side edge parts thereof, and the cutter blades make sliding contact with the inside surface of an arch-shaped outer cutter while making reciprocating motion; and in the present invention, the end portions of two adjacent cutter blades are joined together to form a joined portion, and this joined portion is connected to the side edge part via a connecting portion.

As seen from the above, in inner cutter of the present invention, the end portions of two adjacent cutter blades are joined together to form a joined portion, and this joined portion is connected to the side edge part via a connecting portion. Accordingly, the cutter blades can vibrate easily, and as a result, the use sound of the electric shaver improves, and it is possible to obtain a good use feeling and pleasant sound. Also, since the stress applied to the cutter blades is dispersed to the joined portion at both ends of the cutter blades and to the connecting portion, the durability of the cutter blades improves.

In the present invention, it is preferable that the inner cutter be made of a metal sheet of an even thickness (for example, a thin sheet of stainless steel), that each cutter blade has a substantially fixed width in the inner cutter reciprocating direction and be joined to the joined portion at both end portions, and that the width of the connecting portion connecting the joined portion to the side edge part be slightly wider than the width of the cutter blade. With this structure, stress on the cutter blades due to the vibration is dispersed to the vicinity of the joined portion and the vicinity of the connecting root portion (the vicinity of the portion of the connecting portion near the side edge part), and this smoothly dispersing stress makes it possible to assuredly improve the durability of the cutter blades.

Both end portions of two adjacent cutter blades can be respectively joined together and connected to the side edge part via the connecting portion. However, the joined portions on both sides of the adjacent cutter blades can be offset by the pitch of exactly one cutter blade. In other words, in the present invention, it is possible to design so that one end portions (first end portions) of each of adjacent cutter blades are joined together, and another end portion (second end portion) of one of these two cutter blades is joined to an end portion (second end portion) of another adjacent cutter blade. In the former structure (in which both end portions of two cutter blades are respectively joined together), the two adjacent cutter blades are essentially integrated and are moved in parallel so that the stress in the vicinity of the root portion of the connecting portion (or the connecting root portion) becomes large, whereas in the latter structure (in which the joined portion at both end portions of the cutter blade is offset by one pitch), the vibration of adjacent cutter blades are not parallel, and stress in the vicinity of the joined portion becomes large. Since the pattern of cutter blade vibration differs in this manner, the created sound changes slightly.

It is preferred to independently provide a connecting portion for each joined portion, and it is also preferred to connect one joined portion to the side edge part via one connecting portion. With this structure, the shape of the connecting portion simplifies, and the processability and durability of the inner cutter improves. It is, however, also possible that adjacent joined portions be joined to a single connecting portion and this connecting portion be connected to the side edge part.

DETAILED DESCRIPTION OF THE INVENTION

Figure 1:
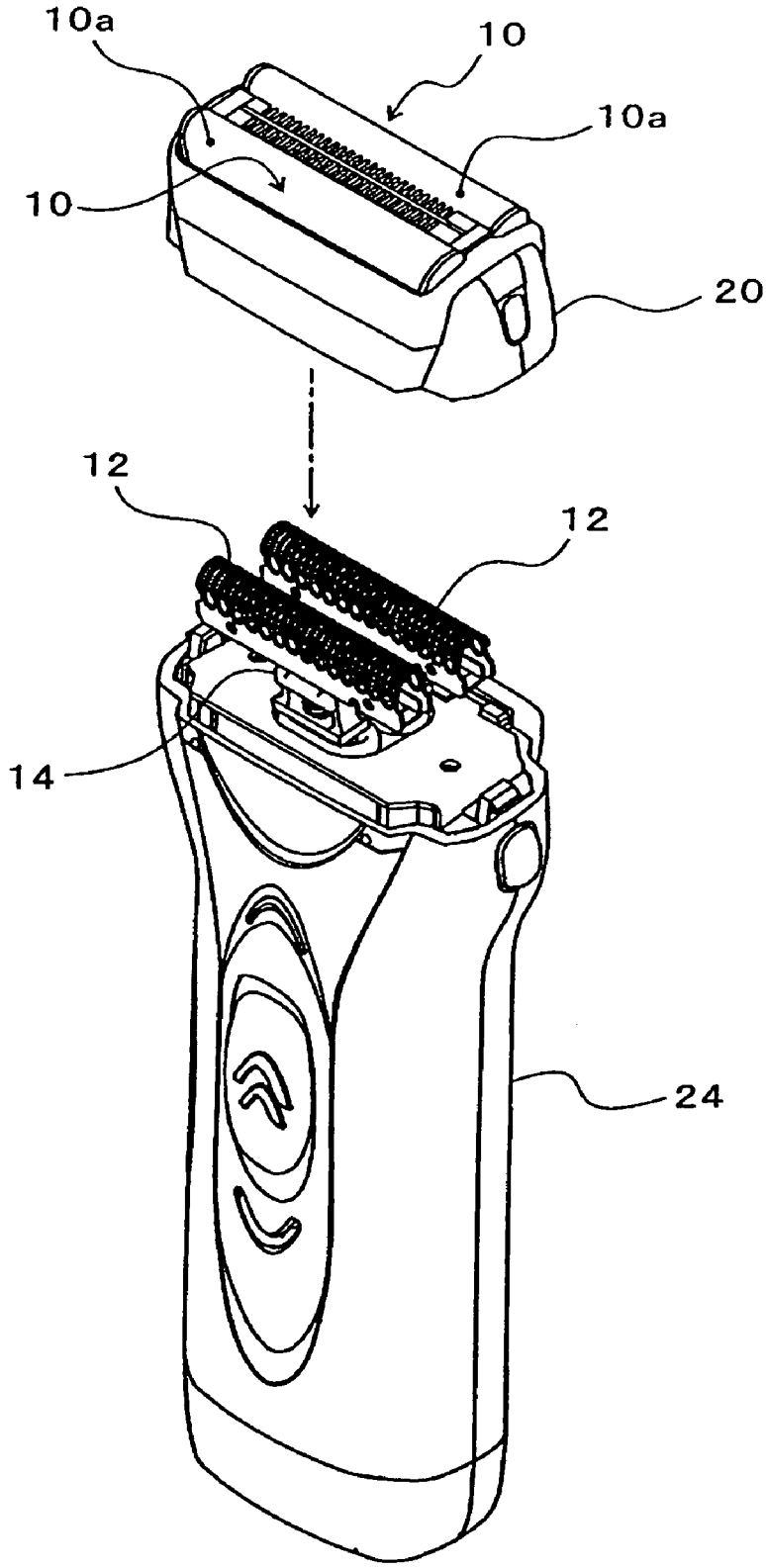
FIG. 1 is a perspective view of the reciprocating type electric shaver according to one embodiment of the present invention.
Figure 2:
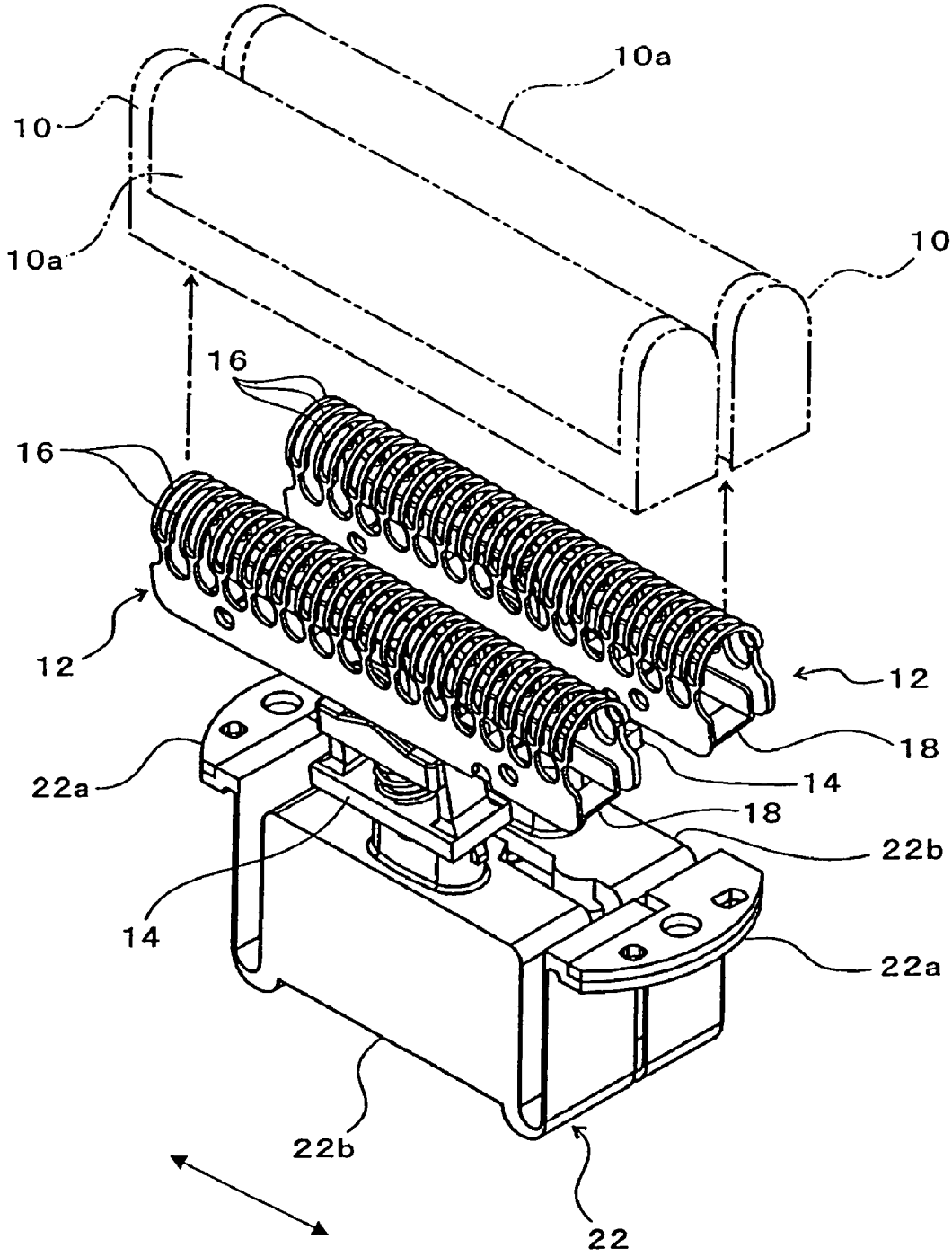
FIG. 2 is an enlarged perspective view of the vicinity of the inner cutters of the shaver.

In FIGS. 1 and 2, the reference numerals 10 refer to outer cutters, 12 are inner cutters, and 14 are inner cutter supporting stands. Each of the outer cutters 10 is comprised of an outer cutter body 10*a* that is obtained by bending a thin metal sheet, such as stainless steel, etc., into an arch shape, and the both end portions in the length direction are closed with cap plates. The arch-shaped curved part of the outer cutter body 10*a* is formed with a plurality of hair introduction openings.

Figure 3:
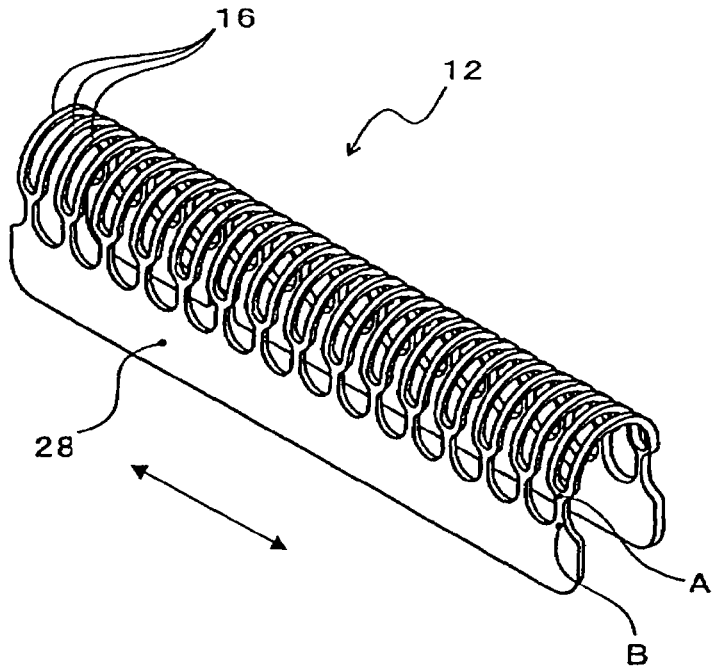
FIG. 3 is an enlarged perspective view of one of two inner cutters.
Figure 4:
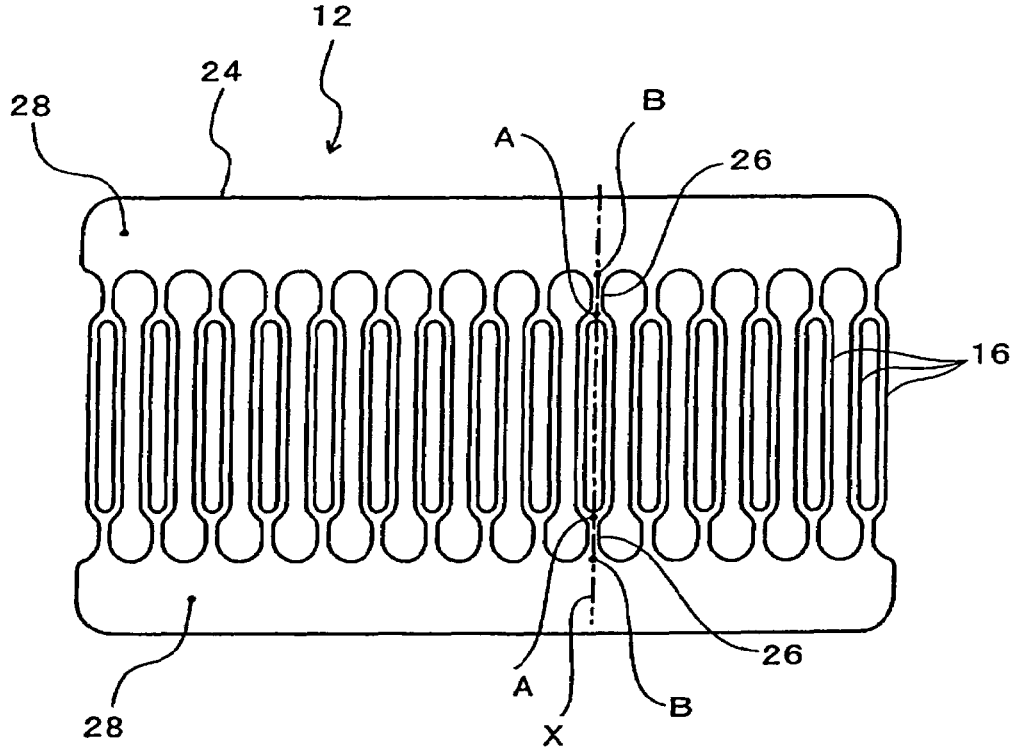
FIG. 4 is an expanded view of the inner cutter of FIG. 3.

The inner cutter 12, as will be described in detail below, is comprised of a plurality of arch-shaped cutter blades 16 that are integrally formed. The arch-shaped outer peripheral surface of each cutter blade 16 forms a curved surface that slides along the inside surface of the outer cutter body 10*a* of the outer cutter 10. More specifically, the inner cutter 12, as can be seen from FIG. 4, is comprised of a thin sheet 24 that is curved into an arch shape as shown in FIG. 3, and a supporting element 18 (see FIG. 2) is fixed to the inside surfaces of the side edge parts 28 and 28 that are parallel in the length direction of the inner cutter 12. The supporting element 18 is held on the supporting stand 14 so that it swivels and is movable vertically. In the shown structure, two outer cutters 10 are provided in parallel in an outer cutter supporting frame 20; and as a result, two inner cutters 12, two supporting elements 18, and two supporting stands 14 are provided so as to correspond to the outer cutters 10.

In FIG. 2, the reference numeral 22 is a vibration body. The vibration body 22 is provided on the upper surface of a shaver housing 24 that has a motor (not shown in the drawings) inside. More specifically, two end portions 22*a* of the vibration body 22 are provided on the shaver housing 24, and central moveable portions 22*b* of the vibration body 22 oscillates in the reciprocating direction (shown by arrow in FIG. 2) of the inner cutter 12. An eccentric pin (not shown in the drawings) fixed to the rotating shaft of the motor is linked to the moveable portions 22*b*, and the moveable portions 22*b* reciprocate with a phase difference of 180° relative to one another. The above-described supporting stands 14 are respectively fixed to the moveable portions 22*b*.

The outer cutters 10 are provided in the outer cutter supporting frame 20 so that it can sink downward or toward the inside of the shaver housing 24, and the supporting stands 14 support the inner cutters 12 with elastic pressure upward. Accordingly, the inner cutters 12 reciprocate while making sliding contact with the inside surfaces of the outer cutter bodies 10*a*.

Next, the inner cutter 12 will be described.

Each of the inner cutters 12 is a thin sheet 24 of an even thickness as shown in FIG. 4, and it is curved into an arch shape and fixed to the supporting element 18. The thin sheet 24 is a sheet of metal such as stainless steel, and it is integrally formed with a plurality of cutter blades 16 by performing a suitable working method such as etching, pressing, etc.

The cutter blades 16 are aligned at a constant pitch in the reciprocating direction of the inner cutter 12 (left/right direction or in the direction shown by arrow in FIG. 3), and they are formed to extend in the direction orthogonal to the reciprocating direction of the inner cutter.

As seen from FIGS. 3 and 4, both end portions of two adjacent cutter blades 16 are joined together to form joined portions A. Accordingly, two adjacent cutter blades 16 form a loop by two opposing joined portions A at both end portions. The joined portions A are respectively connected to the side edge parts 28 of the thin sheet 24 with connecting portions 26 in between, and this configuration is made for all the cutter blades 16. The connecting portions 26 on both ends of the cutter blades 16 are connected to the side edge parts 28 by their connecting root portions B. Therefore, in the shown embodiment, the joined portions A and the connecting root portions B are positioned on the same (common) straight line X which is orthogonal to the reciprocating direction of the inner cutter 12.

The thin sheet 24 thus formed is bent into an arch shape as shown in FIG. 3, and both side edge parts 28 are fixed to the supporting element 18 as previously described.

Each of the cutter blades 16 has a fixed width and extends to the vicinity of the joined portion A. The width of the connecting portion 26 is slightly larger than the width of the cutter blade 16. The thin sheet 24 has an essentially even thickness overall, so that when external force is applied to the cutter blades 16 in the reciprocating direction of the inner cutter 12, the external force is first absorbed in the vicinity of the joined portions A; and if the external force increases higher, the external force is absorbed in the vicinities of the connecting root portions B. Thus, the external force is dispersed and absorbed at a plurality of locations A and B, and thus the stress is not excessively concentrated, and the cutter blades 16 have an increased durability. Therefore, the cutter blades 16 can be formed long, so that the cutter blades 16 are able to make sufficient vibrations, thus improving the shaving sound.

Figure 5:
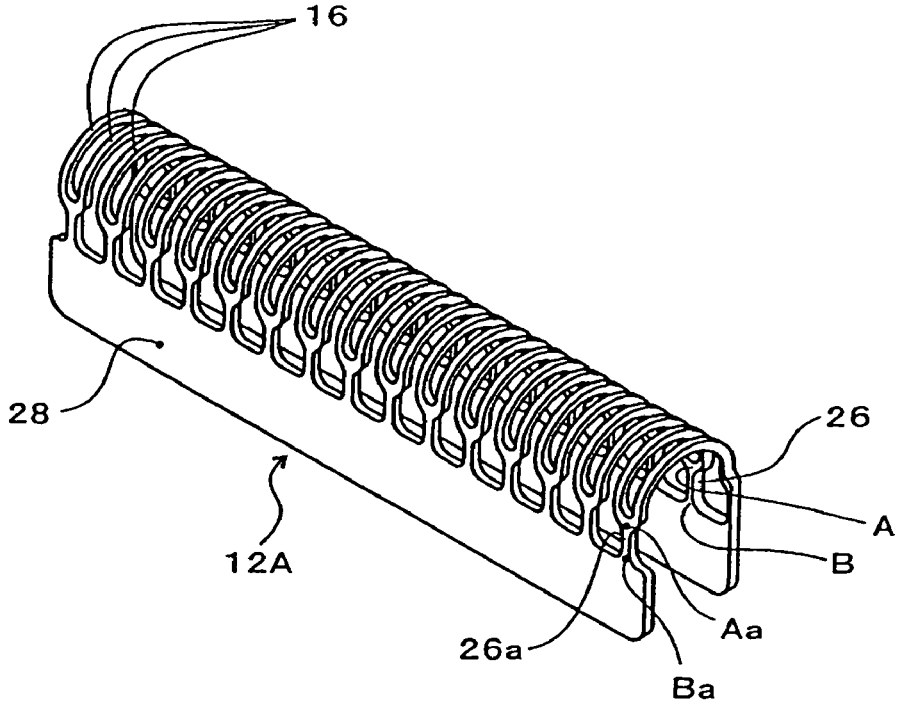
FIG. 5 is a perspective view of an inner cutter according to another embodiment of the present invention.
Figure 6:
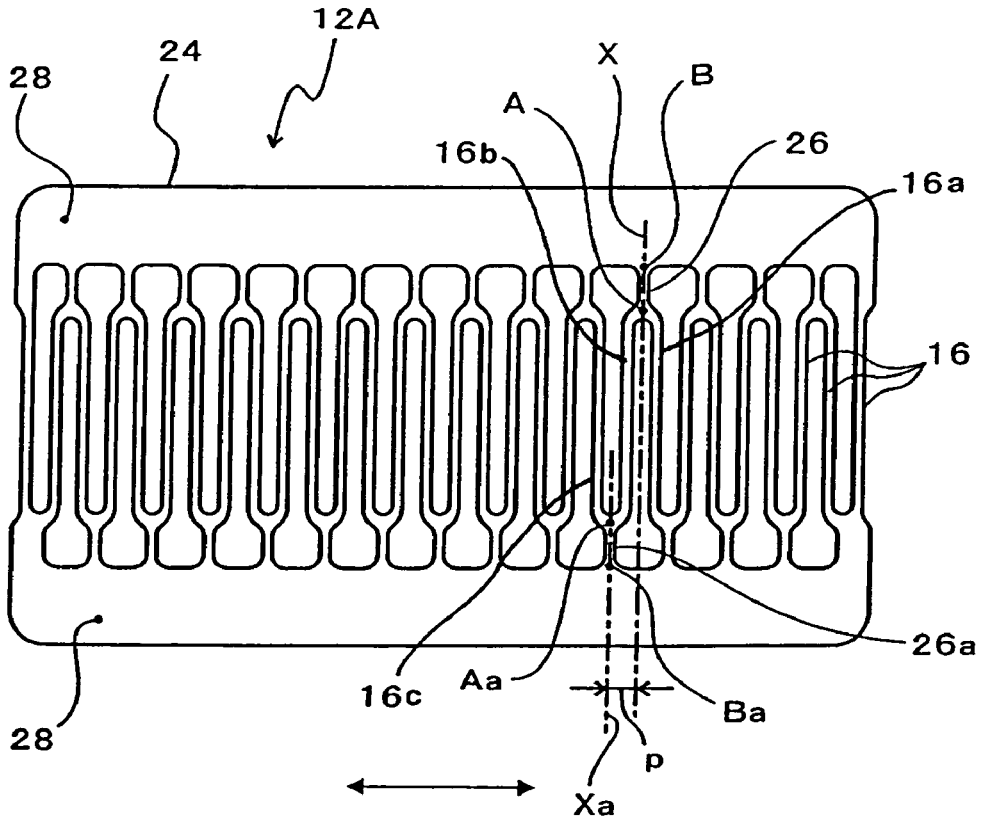
FIG. 6 is an expanded view of the inner cutter of FIG. 5.

FIG. 5 is a perspective view of the inner cutter 12A according to another embodiment of the present invention, and FIG. 6 is an expanded view thereof.

In this embodiment of FIG. 5, the joined portions A and Aa are located at both end portions of the cutter blades 16 so that they are offset by exactly the amount p, which is one pitch of the cutter blade 16. In other words, end portions (first end portions) of two adjacent cutter blades 16*a* and 16*b* are joined by joined portion A, while the other end portion (second end portion which is on opposite side from the first end portion) of one of the two cutter blades (16*b*) and end portion (second end portion) of another cutter blade 16*c* adjacent to this cutter blade 16*b* are joined by a joined portion Aa, so that these joined portions A and Aa are offset by exactly the amount p, which is one pitch of the cutter blade 16 in the inner cutter reciprocating direction; and this wavy pattern configuration is continuously made for all the cutter blades 16.

In this structure, a straight line X passing through the joined portion A and the connecting root portion B of the connecting portion 26 is offset by exactly the amount p, which is one pitch of the cutter blade 16, relative to a straight line Xa passing through the joined portion Aa and the connecting root portion Ba of the connecting portion 26*a*. Accordingly, when external force is applied to the cutter blades 16 in the inner cutter reciprocating direction (see arrow in FIG. 6), adjacent cutter blades 16 vibrate in a complicated manner while affecting one another and create a shaving sound whose sound quality is slightly different from the case of the inner cutter 12 shown in FIGS. 2 to 4.

In FIGS. 5 and 6, the same reference numerals are assigned to the corresponding portions to those in FIGS. 2 to 4, and the description thereof is omitted.

Figure 7A:
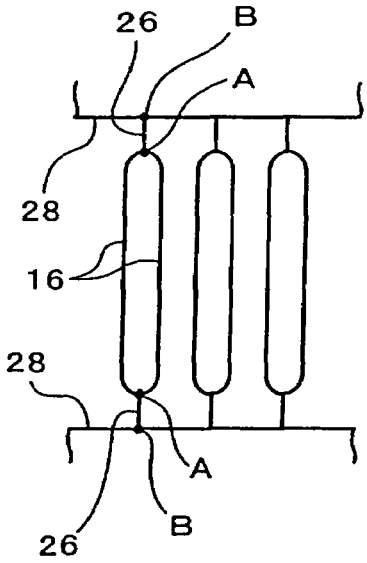
FIGS. 7A through 7D show examples of the arrangements of cutter blades according to the present invention.
Figure 7B:
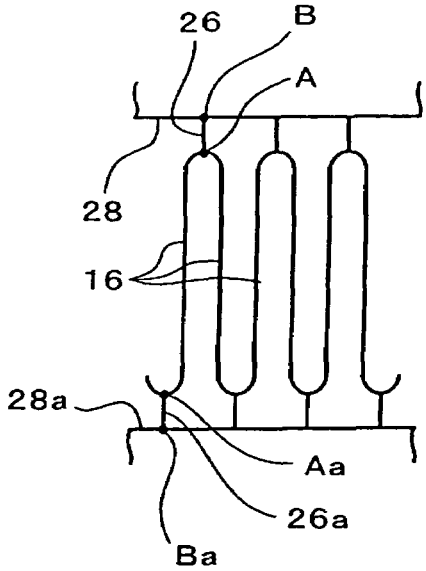
Figure 7C:
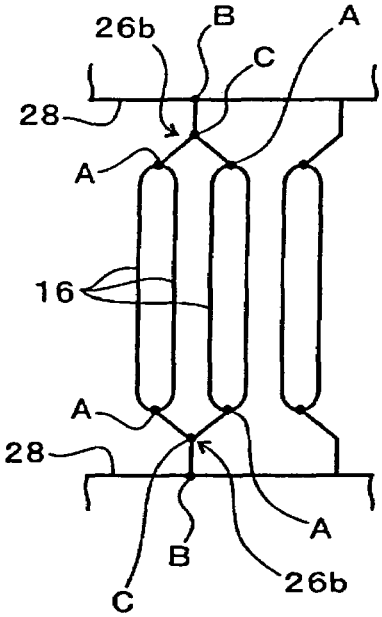
Figure 7D:
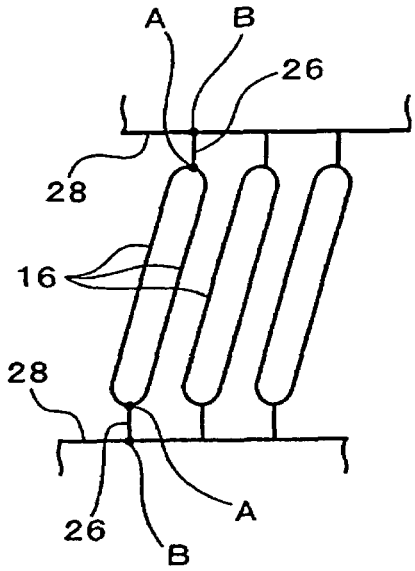

FIGS. 7A through 7D illustrate the manner of arrangement of the cutter blades, etc. in the present invention. FIG. 7A and 7B show the configurations of the above-described structures of FIGS. 3 and 4 and of FIGS. 5 and 6, respectively; and FIGS. 7C and 7D show other arrangements.

In the configuration of FIG. 7C, each of the connecting portions 26*b* is comprised of two adjacent joined portions A that are joined together by an intermediate joined portion C, and this connecting portion 26 is connected to the side edge part 28. In the configuration of FIG. 7D, the cutter blades 16 are slanted with reference to the inner cutter reciprocating direction, but the arrangement of the joined portion A, connecting portion 26, and connecting root portion B is essentially the same as that of FIG. 7A.

In the configuration of FIG. 7C, since the intermediate joined portions C are added, stress applied to the cutter blades 16 can be dispersed even more assuredly, and the inner cutter 12 has a durability that is increased even higher compared to the structure without the intermediate joined portions C. In the configuration of FIG. 7D, hair is obliquely cut by the cutter blades 16 and provide an improved hair shaving feeling (cutting feeling). In the structures of FIGS. 7C and 7D, as in FIG. 7B, the joined portion A and the connecting root portion B at one end portion of a cutter blade 16 and the joined portion Aa and the connecting root portion Ba at another end portion thereof can be offset by p, the amount of one pitch.

The invention claimed is:

1. An inner cutter for a reciprocating type electric shaver in which a plurality of arched shaped cutter blades are integrally formed on side edge parts thereof, and said cutter blades make sliding contact with an inside surface of an arched shaped outer cutter while making reciprocating motion, wherein:

only end portions of each pair of two adjacent arched shaped cutter blades of said plurality of arched shaped cutter blades are joined together by a single joined portion to form a plurality of separate joined portions and a plurality of separate pairs of two adjacent arched shaped cutter blades, and each of said plurality of separate joined portions is independently connected to said side edge part via only a single transversely extending connecting portion.

2. The inner cutter for a reciprocating type electric shaver according to claim 1, wherein said inner cutter is made of a metal sheet of a substantially even thickness, said cutter blades have substantially fixed width, and said connecting portion has a width that is larger than said cutter blade.

3. The inner cutter for a reciprocating type electric shaver according to claim 2, wherein each of said plurality of separate joined portions is U-shaped.

4. The inner cutter for a reciprocating type electric shaver according to claim 1, wherein first end portions of each of two adjacent of said plurality of arched shaped cutter blades are joined together by said separate joined portions, and a second end portion of one of each of two adjacent of said plurality of arched shaped cutter blades is joined to a second end portion of another adjacent of said plurality of arched shaped cutter blades by said separate joined portions.

5. The inner cutter for a reciprocating type electric shaver according to claim 2, wherein first end portions of each of two adjacent of said plurality of arched shaped cutter blades are joined together by said separate joined portions, and a second end portion of one of each of two adjacent of said plurality of arched shaped cutter blades is joined to a second end portion of another adjacent of said plurality of arched shaped cutter blades by said separate joined portions.

* * * * *